United States Patent [19]

Capuano

[11] 4,017,930

[45] Apr. 19, 1977

[54] UNIVERSAL DEVICE FOR PRESSING SOLES ON SHOES

[75] Inventor: Antonio Capuano, Vigevano, Italy

[73] Assignee: Sigma S.p.A., Vigevano, Italy

[22] Filed: Jan. 23, 1976

[21] Appl. No.: 651,945

[30] Foreign Application Priority Data

Jan. 29, 1975 Italy ..... 19723/75

[52] U.S. Cl. ..... 12/33

[51] Int. Cl.[2] ..... A43D 89/00

[58] Field of Search ..... 12/33, 38

[56] References Cited

UNITED STATES PATENTS

| | | | |
|---|---|---|---|
| 523,228 | 7/1894 | McArdle | 12/38 |
| 2,205,400 | 6/1940 | Finn | 12/38 |
| 2,985,901 | 5/1961 | Actis | 12/38 |
| 3,058,131 | 10/1962 | Schultz et al. | 12/38 |

*Primary Examiner*—Patrick D. Lawson
*Attorney, Agent, or Firm*—Amster & Rothstein

[57] ABSTRACT

A device for cementing soles on the base surface of shoes is provided.

The device is provided with a cushion formed of a plurality of blocks resiliently movable and adapted to automatically lock in a position where they mate the shoe lower surface. This locking operation is controlled by a microswitch actuated by the block corresponding to the shoe waist. The heel pressing block is also locked simultaneously with said plurality of blocks.

8 Claims, 3 Drawing Figures

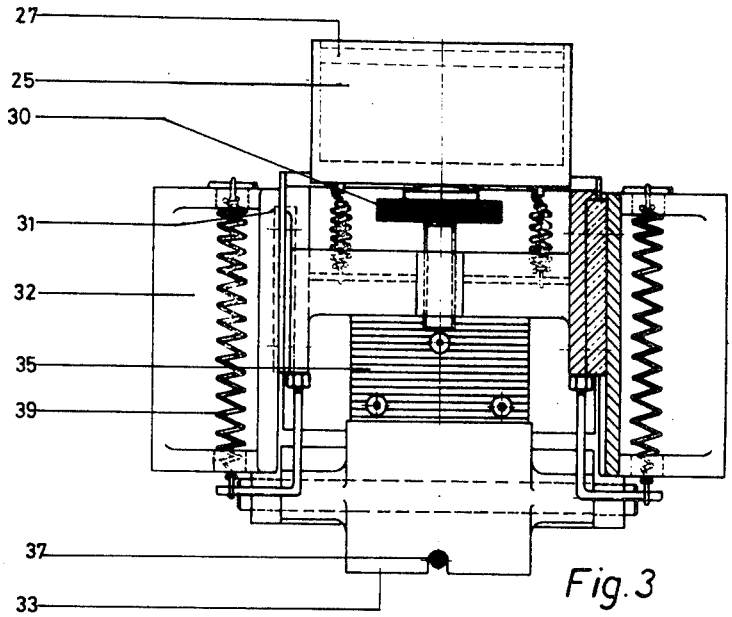
Fig. 3
Fig. 2
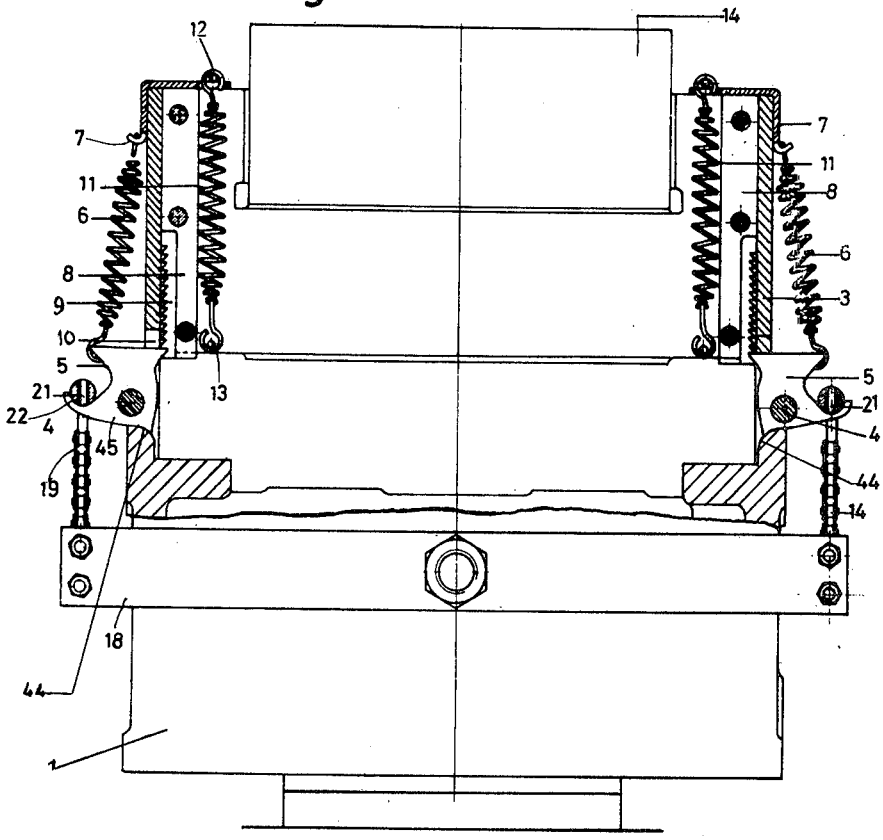

UNIVERSAL DEVICE FOR PRESSING SOLES ON SHOES

The present invention relates to a device for pressing soles on shoes and more particularly such a device which can be used in connection with shoes of any type with or without attached heels.

To obtain a safe and reliable connection between shoe and sole it is necessary that, during the cementing operation, both these parts should be squeezed against each other for a certain time with a high pressure in order that the cement can completely exert its own action.

To evenly distribute the necessary pressure on the sole, the latter should bear on a support of resilient material, the periphery of which mates the lower surface of the sole shaped according to that of the shoe, the support being sufficiently stiff and strong to accommodate the working pressure.

This requirement is difficult to meet in that there is in commerce a great variety of shoe types, the lower surface of which is shaped very differently from shoe to shoe.

Thus, there are flat shoes, shoes with already attached heel, shoes wherein the heel is attached after the sole cementing operation, rubber sole shoes, all the above mentioned shoes being manufactured both as men's and as ladies' shoes. There are also, only for ladies, the Louis heel shoes.

In performing the pressing operation on flat shoes no difficulties are encountered because the fore part thereof is nearly flat, the shoe waist is generally shallow and the surface corresponding to the heel plane is nearly parallel to the nearly flat surface of the fore part or tip. Difficulties with the other types of shoes, particularly Louis heel shoes having a very irregular shape of the lower surface thereof. The latter type of shoes has a fore part substantially flat corresponding to the foot sole, a shoe waist more or less deep at the center and a surface substantially perpendicular to the first one (slightly inclined according to the shape of heel) and corresponding to the heel breast. In addition to the foregoing it is to say that, by exerting a substantial pressure on the latter surface, the heel is exposed to the risk of breaking since it is very slender and brittle. Further, the heel is generally attached to the shoe by means of a nail or screw and therefore it can easily move away from the correct position.

There are in commerce various machines for pressing soles on shoes of any type, these machines being practically more or less effective. However, all of the prior art machines are equipped with one or more devices, generally referred to as "cushions," on which the shoes are supported in order to be subjected to the working pressure. However, the present "cushion" devices have many restrictions as to the adaptability thereof to the different shoe types. These devices must be normally adjusted in order to adapt them to the different types of shoes to be pressed (different pattern or different length among the same patterns or different height of heels). For this purpose the cushions are formed of a plurality of blocks which can be adjusted in height independently of each other.

Devices have already been proposed wherein some blocks of the cushion at the shoe waist are automatically pushed against the sole and mate the periphery thereof. However, in these devices it is again necessary to manually adapt the remaining blocks to the bearing surface of sole and heel.

It is the object of this invention to provide a "cushion" device which can be automatically adapted by the sole and heel to the periphery thereof without requiring any manual adjustment before the pressing operation has been carried out.

More particularly the device according to this invention is characterized in that the blocks corresponding to the bearing surface of sole and waist of the shoe are resiliently movable in a vertical direction by the thrusting action exerted thereon by the shoe sole against the reacting forces of springs through which the blocks are connected to a stationary part of the device. According to a feature of the invention each block is provided with an element adapted to engage a locking assembly controlled by a device actuated by the block corresponding to the highest waist portion of the shoe so as to lock the blocks in a position wherein they are all adapted to the shoe sole periphery.

According to another feature of the invention, the block corresponding to the heel bears on a slide moving by resilient action in a vertical direction under a thrust force exerted thereon by the shoe heel against the reaction force of a spring by which the slide is connected to a stationary part of the device, the slide being provided with a ratchet bar for engagement with a pawl cooperating with an assembly actuated by the block corresponding to the highest waist portion of the shoe so as to lock the slide simultaneously with the locking of the blocks corresponding to the bearing surface of shoe sole and waist.

The foregoing and other features of the invention will be readily understood from the following detailed description, given merely by way of example and therefore not intended in a limiting sense, of an embodiment of the invention in connection with the accompanying drawings wherein:

FIG. 2 is a cross-sectional view of the cushion of the device in FIG. 1; and

FIG. 3 is a front elevational view of the device of FIGS. 1 and 2, with some portions thereof omitted.

Figure 1:
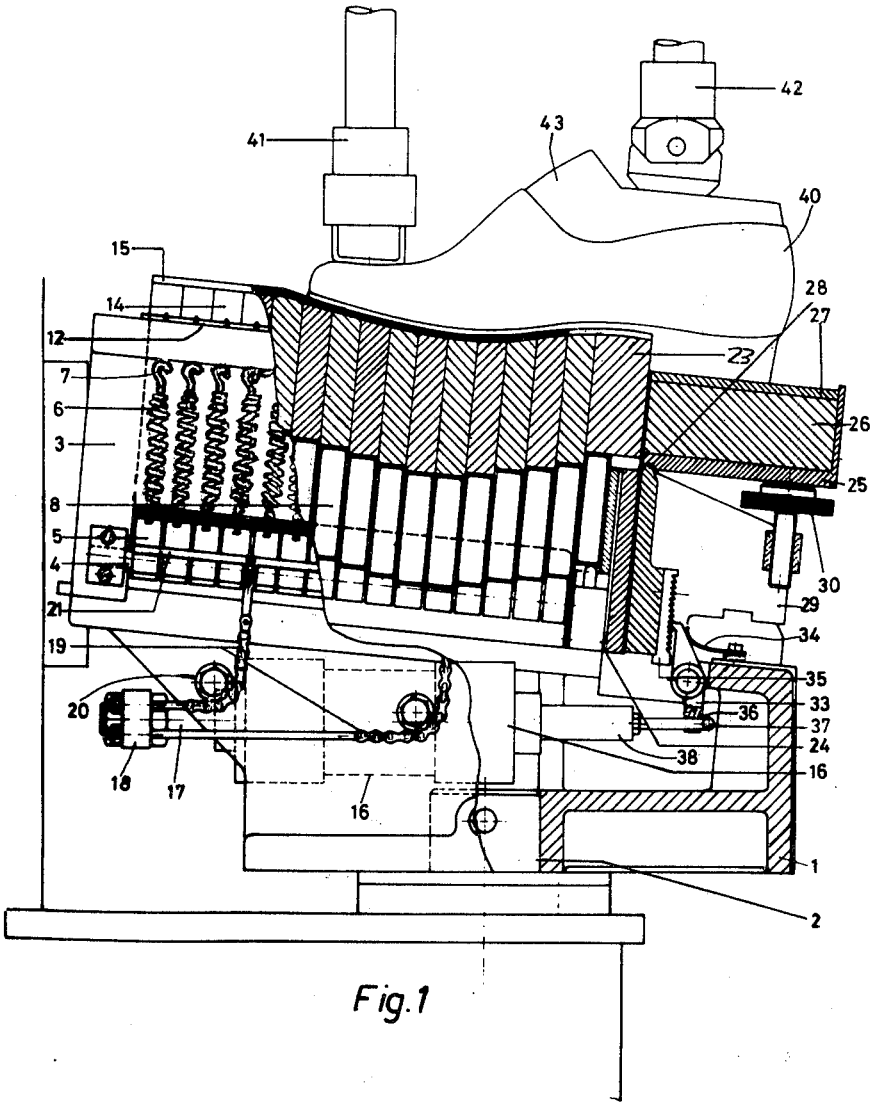
FIG. 1 is a side elevational view, partially sectioned, of a device according to the invention, equipped for pressing soles of shoes of a determined type, already preset to press the shoes.

Referring first to FIGS. 1 and 2, there is shown the device according to the invention which is fastened to a base plate 1 rigidly secured to a piston 2 of a cylinder belonging to the shoe pressing machine on which the device is mounted and which can be operated by hydraulic or pneumatic means or the like.

The device comprises a front portion corresponding to the sole bearing surface and the waist of shoe and a rear portion corresponding to the heel.

As it is seen in FIG. 2, the front portion of the device comprises a frame 3 formed of four steel plates welded to each other and fastened by means of screws to the base plate. On two shafts 4 fastened to the base plate 1 and arranged on both sides of frame 3 a plurality of pawls 5 are pivoted, which are held in hooked condition, as discussed hereinafter, by means of springs 6 anchored at the other end to hooks 7 extending from the frame 3.

Within the frame 3 a plurality of steel blocks 8 are arranged, which have on the two external sides two ratchet bars 9 adapted to cooperate with pawls 5. These ratchet bars can engage pawls 9 through windows 10 provided in the side walls of frame 3. As best shown in FIG. 1, the steel blocks are formed of two metal sheet elements bent to provide in the lower transverse portion a hollow body. On both sides of blocks, between the bent portions of the metal sheet elements, springs 11 are housed, which are anchored at the upper end to a rod 12 fastened to frame 3 and at the lower end to a pin 13 which connects to each other the metal sheet elements of each block 8. Springs 11 are in tension at all times also when the device according to the invention is in the rest position. Blocks 8 are movable downwardly to contact the base plate and guided by the side walls of frame 3. Blocks have a C-shape in cross-section with the hollow portion being directed upwardly. In this hollow portion prismatic rubber blocks are housed, which form the support surface of the sole bearing surface and waist of shoe to be cemented. Above rubber blocks 14 a leather sheet 15 is arranged, on which the shoe bears.

Inside the base plate 1 a pneumatic cylinder 16 provided with a pair of opposite piston rods is arranged. On the end of one rod 17 a cross-piece 18 is secured. At both ends of cross-piece 18 a pair of chains 19 are secured, which through a pair of sprocket wheels 20, are connected to a rod 21 bearing within a seat 22 provided in the pawls 5. While in this embodiment a pneumatic cylinder is used, the actuating device of the pawls can be of any type, e.g. a hydraulic, mechanical or electromechanical device.

In order to permit the rubber blocks to slide with respect to each other sheets (not shown) of polished steel are secured to the steel blocks 8, which sheets separate the rubber block from each other in order to avoid the friction generating between the rubber blocks and also a rubber block from bearing against two adjacent steel blocks.

The rubber block corresponding to the shoe waist, indicated in FIG. 1 by the numeral reference 23, makes a limited stroke, generally of some millimeters, before entering in contact with frame 3. In a housing provided within the frame below the rubber block 23 a microswitch 24 is arranged, which is depressed by the rubber block 23 just before the latter is at the end of its stroke.

The rear portion for supporting the heel comprises a cup 25 in which a rubber pad 26 is provided which is cemented to the bearing plate 27 contacting the heel. Cup 25 bears on a rib 28 of the slide 29 supporting the heel and on a knurled head screw 30 threaded in slide 29 and providing the adjustment of inclination of heel supporting cup. Heel supporting slide 29 slides on prismatic bronze guides 31 secured to a guide support 32 removably carried on the base plate 1 and centered thereon. On the guide of heel supporting slide a pawl 33 is pivoted which engages a ratchet bar 35 carried by slide 29 under the bias of a spring 34. In pawl 33 a notch 36 is provided for receiving a T-shaped element 37 screwed on the other piston rod 38 of pneumatic cylinder 16. Slide 29 is constantly held in upper position by means of springs 39 anchored to the slide guide 32.

The above described device operates as follows:

After the shoe 40 has been placed on the leather sheet 15 supported by rubber blocks 14 and on the heel supporting plate 27 a switch (generally a foot-operated switch) is actuated, which controls both a valve (not shown) of the cylinder 2 and a valve (also not shown) of pneumatic cylinder 16. The cushion formed by rubber blocks and shoe are pressed by the piston 2 of the cylinder against a front stop member 41 and a rear stop member 42 both fastened to the press basement and positioned at the tip and heel of shoe, respectively. In this operational step the cylinder 16 causes pawl 33 to be released from the ratchet bar 35 of slide 29 and pawls 5 are released from ratchets. All of blocks and heel supporting slide are held in the upper position by the associated return springs and therefore are free of moving downwardly under the action of the sole and heel of shoe.

As mentioned above, the shoe contacts the stop members 41 and 42 directly or through the last 43 inserted therein so that sole and heel under the lifting force of cylinder 2 have pushed downwardly the rubber blocks and the heel supporting plate until the block 23 corresponding to the shoe waist, actuates the microswitch 24 and comes in contact with the frame 3. Just before this contact takes place, the blocks have assumed the configuration shown in FIG. 1, i.e. they have been lowered according to the shoe sole and heel contours. The microswitch 24 disconnects the magnetic valve controlling the pneumatic cylinder 16 which is vented to the atmosphere and releases the pawls 5 and 33 so that, under the bias of the associated springs, these pawls 5 can engage the ratchet bar 9 of steel blocks 8 and the ratchet bar 35 of slide 29, the steel blocks 8 and slide 29 being fastened to the base plate 1. The engagement takes place automatically because the pawls 5 are biased by springs 6 against the ratchet blocks 8 and as the push downwardly increases also the engagement force of pawls in the teeth increases. The force is transmitted directly from the tooth 45 of pawl 5 to the bearing rib 44 of pawls provided integrally with the base plate 1. In this manner the pawl shaft 4 must no longer support the pushing force of blocks 8.

At this point the rubber blocks 14 have been pushed downwardly by the shoe each of a distance necessary to be adapted to the outer periphery of the shoe sole and heel, but without being resiliently deformed. The cylinder 2 continues lifting the cushion made of rubber blocks and this movement is possible because the rubber blocks 14 and 26 squeeze. As the reaction force exerted by the rubber blocks equals the force of the cylinder 2, the latter stops and the shoe sole and heel are completely in contact with all rubber blocks and the bearing surface of heel. The shoe is ready to be pressed.

During and after the pressing operation air is fed to the pneumatic cylinder 16 which disengages the pawls. However, the pneumatic cylinder 16 could not be actuated and the pawls brought automatically out of engagement under the force of the associated springs.

It is seen that during the whole operation of the device no intervention of an operator is required for carrying out a manual adjustment. With the above described device therefore, it is possible to preset the shoes for the pressing operation in a manner completely automatic.

While a single embodiment of the invention has been described and illustrated, it is obvious that various changes and modifications can be made without departing from the scope of the invention.

What I claim is:

1. A device for pressing soles on shoes comprising a cushion formed of a plurality of blocks for mating with the lower face of the shoe;

a base portion;

actuating means mounted on said base portion;

a frame mounted on said base portion and having said blocks resiliently movable in a vertical direction therewithin;

means connecting said blocks to said frame exerting a downward biasing force on said blocks;

a plurality of first locking means corresponding to and mounted respectively on each of said blocks;

a plurality of second locking means mounted on said frame, said second locking means corresponding in number with said first locking means, and each of said first and second locking means engageable in selective locking engagement in pairs to maintain a corresponding block in its pressing vertical position; and means associated with said second locking means to provide release of said locking engagement upon selective operation of said actuating means.

2. A device according to claim 1 wherein said blocks are in adjacent sliding relationship with each other, the mating of said blocks and the shoe lower face extending from the tip of the shoe to the shoe waist, and the one of said blocks associated with the shoe waist effecting the operation of said actuating means.

3. A device according to claim 1 wherein said first locking means comprises a plurality of ratchets, and said second locking means comprises a plurality of pawls.

4. A device according to claim 3 wherein rod means is provided in contact with each of said pawls, and said actuating means comprises a piston and cylinder arrangement connected through chain means to said rod means to effect disengagement of said ratchets and said pawls upon actuation thereof.

5. A device according to claim 1 wherein said blocks each have a lower part formed in metal in a C-shape, and said blocks each have an upper part formed of rubber to support the shoe lower face.

6. A device according to claim 5 wherein tension means connects said lower part of each block to said frame to bias said blocks downwardly.

7. A device according to claim 3 wherein a plurality of bearing ribs are provided on said frame in respective contact with each said pawl, and the pressing force through said blocks is transmitted to said frame by means of each said rib.

8. A device according to claim 1 wherein the heel of the shoe is supported on a pad mounted to slide on said frame and held in the pressing engagement by a further ratchet and pawl arrangement operated by said actuating means simultaneously with the operation of said locking means.

* * * * *